US005217175A

United States Patent [19]

Stitz et al.

[11] Patent Number: 5,217,175

[45] Date of Patent: Jun. 8, 1993

[54] WINDING SPINDLE

[75] Inventors: Albert Stitz, Kurten; Martin Zingsem, Remscheid, both of Fed. Rep. of Germany

[73] Assignee: Barmag AG, Remscheid, Fed. Rep. of Germany

[21] Appl. No.: 923,822

[22] Filed: Aug. 3, 1992

[30] Foreign Application Priority Data

Aug. 2, 1991 [DE] Fed. Rep. of Germany ..... 4125652
Aug. 17, 1991 [DE] Fed. Rep. of Germany ..... 4127264

[51] Int. Cl.[5] ..... B65H 54/54
[52] U.S. Cl. ..... 242/46.4; 242/46.6
[58] Field of Search ..... 242/46.4, 46.6, 46.2, 242/46.3, 46.5, 46.7, 46.21, 68.2, 68.1, 68, 68.3, 68.4, 72 R, 72.1; 279/2.01, 2.02

[56] References Cited

U.S. PATENT DOCUMENTS 4,175,712 11/1979 Schippers et al. ..... 242/46.4
4,223,849 9/1980 Schippers et al. ..... 242/46.4
4,429,838 2/1984 Lenk et al. ..... 242/46.4
4,830,299 5/1989 Mutter et al. ..... 242/46.4

FOREIGN PATENT DOCUMENTS

0270826B1 11/1987 European Pat. Off. .
2457821 6/1976 Fed. Rep. of Germany .

*Primary Examiner*—Stanley N. Gilreath
*Attorney, Agent, or Firm*—Bell, Seltzer, Park & Gibson

[57] ABSTRACT

A yarn winding spindle is disclosed which is characterized by the ability to grip the interior of a tubular bobbin during the winding of the yarn thereon and then release the bobbin to facilitate doffing. The spindle comprises a cylindrical support member which is composed of a plurality of axially spaced apart annular entrainment members and a plurality of annular, elastic clamping members mounted between adjacent entrainment members. The elastic members are configured and internally self-biased so as to assume a radially extended position to engage the bobbin in the absence of an external force being applied thereto, and to assume a radially retracted position to release the bobbin upon a biasing force being applied thereto.

15 Claims, 5 Drawing Sheets

WINDING SPINDLE

BACKGROUND OF THE INVENTION

The present invention relates to a winding spindle for use on a yarn take-up machine, and of the type which is adapted to coaxially mount a yarn winding bobbin. More particularly, the invention relates to a winding spindle of the described type and wherein the winding bobbin can be clamped on the spindle by applying radial forces, the radial forces being applied by clamping members.

A winding spindle of the described type is known, for example, from DE-OS 24 57 821. In this known winding spindle, the winding bobbin is inserted with its one end over a supporting surface and clamped in place in the region of the other end by a radially widening, elastic ring. To this end, the elastic ring is biased by a compression spring, and is thereby axially compressed. This axial compression results in an increase in diameter and a radial clamping force being exerted on the winding bobbin.

The above construction permits radial forces to be applied to the winding bobbin only to a limited extent, since the change in diameter of the elastic ring is limited. Among other things, this limitation results from the fact that when the radial enlargement of the elastic ring becomes too great, the running position of the winding bobbin could diverge from the axially concentric position, thereby causing problems of imbalance.

Another problem is that the enlargement of the diameter is dependent on the force of the associated spring. In general, stronger springs allow the elastic rings to be compressed to a greater extent, thereby improving the attainable enlargement of diameter. However, the mass of the winding spindle increases as a result of this construction, which is not desirable in view of the high spindle speeds usual at present.

It is known from EPO Patent 270 826 B1 that the elastic ring can be widened by a cone arranged in its inside diameter, and where the cone is biased by axial spring forces. To release the tension, the axially directed compression spring is compressed such that the cone is moved from the inside diameter of the elastic ring in the direction of the smaller cone diameter. In so doing, the elastic ring relaxes and releases the winding bobbin.

The above system needs to overcome very high frictional forces, since the axial movement of the cone generates, while the elastic ring widens, an increasing surface pressure between the cone and the elastic ring. Therefore, it is necessary that the compression springs be able to apply adequately high compressive forces, in particular during the decisive clamping phase of the pertinent elastic ring, which necessitates a correspondingly strong compression spring and a correspondingly high bias.

It is accordingly an object of the present invention to provide a winding spindle which, while being of the lightest possible construction, is able to apply with little damage to the winding bobbins the highest possible clamping forces.

SUMMARY OF THE INVENTION

The above and other objects and advantages of the present invention are achieved in accordance with the present invention, by the provision of a winding spindle in which the clamping members are rubber-elastic, and which are designed and installed such that they exert the radial clamping forces on the winding bobbin by the action of their internal forces and substantially without the action of external forces, and that they can be released by applying external forces by means of a biasing force applying means integrated in the winding spindle.

More particularly, the present invention comprises a cylindrical support member which defines an axial direction, the support member including at least one elastic clamping member mounted on the periphery thereof, with the at least one elastic member being configured and internally self-biased so as to assume a radially extended position in the absence of an external force being applied thereto and to assume a radially retracted position upon a biasing force being applied thereto, and means for selectively applying a biasing force to the at least one clamping member so as to permit its radial outward extent to be moved between the extended and retracted positions.

The invention results in the advantage that the clamping members apply the necessary clamping forces in a condition unbiased by external forces, whereby it becomes unnecessary to apply any external forces whatsoever on the winding spindle during the take-up operation. As a result, it is possible to reduce the mass of the winding spindle in a simple manner. Furthermore, it is possible to lessen the susceptibility to breakdown.

Another advantage results from the fact that several clamping members can be serially arranged one after the other along the length of the support member, whereby it becomes possible to increase the clamping force.

In comparison with the version known from DE-OS 24 57 821, the present invention has the further advantage that an axial clamping force is not needed to obtain a clamping effect. In the case of several successively arranged clamping members, the axial clamping force would have to overcome the developing frictional forces which become axially operative from clamping member to clamping member, so as to still build up adequate compressions and thus frictional forces on the more remote clamping members.

The invention has recognized that the clamping of the winding bobbin with an axial clamping force results in considerable losses, since the axial force applied as a whole from one clamping member to the next clamping member is reduced respectively by the developing, axially operative frictional force of the associated clamping member. These losses can be overcome only by overdimensioned axial clamping springs, whereby the mass of winding spindle would become disproportionately large.

In accordance with the present invention, the clamping forces develop only by the internal forces within the clamping members, which can be realized, for example, by a special configuration of the clamping elements. This special configuration allows a certain radial bias to form in the installed clamping member, which causes the latter to contact the winding bobbin in radial clamping engagement.

The radial bias forms since the outside diameter of a clamping member projects in its unbiased condition beyond the inside diameter of the winding bobbin. As a result, a radial compression of the clamping member is achieved when the winding bobbin is inserted, which permits the necessary clamping force to develop. The invention has recognized that these internal forces can be adequately strong, whereby it is possible to do without the application of a force from the outside to generate a clamping force.

To compensate for the internal forces of the clamping members when changing the winding bobbin, a force applying means is used which is integrated in the winding spindle, and which needs to be engaged with the external source of energy only when a change of the winding bobbin is imminent. Therefore, the constructional requirement for the winding spindle of the present invention is minimized.

It is of importance that while the clamping members are relaxed with respect to the clamping on the inside wall of the winding bobbin, upon applying external forces by means of a force applying means which is integrated in the winding spindle, they are simultaneously tensioned with respect to their internal forces when the winding bobbin is released. This is an important feature of the invention. Due to the increase of the internal forces in the clamping member when the winding bobbin is released, the clamping members are put in a position in which they deform solely from their internal forces back to their clamping position when the force applying means is disengaged, and they then apply the radial clamping forces to the inside wall of the winding bobbin.

In a preferred embodiment, the clamping members each have a radially, outwardly curved cross section and form with their convex outside an area of clamping engagement, and these areas lie in the unbiased condition against the inside wall of the winding bobbin. Also, the clamping members support themselves at the same time in the region of radially inward supporting areas. The supporting areas may be arranged on the winding spindle, and as a result, the clamping members have a bias between the winding spindle and the winding bobbin.

A curved cross section of the clamping members offers in addition the advantage that the springiness can be influenced to a certain extent by the profiling, and that when the clamping members are relaxed, it is necessary to compensate for the bulge only to such an extent that the area of clamping engagement no longer contacts the winding bobbin.

To disengage the clamping members during a package doff, several methods offer themselves to retract the radial expansion of the clamping members. This may be achieved by compressive forces, provided a material is used for the clamping members, which contracts due to pressure, or that a shape for the clamping members is selected which produces a radial inward movement under pressure.

In the case of a curved cross section of the clamping members, it is possible to retract the bulge with an axially operative tensile force. In this instance, recourse may be taken to conventional materials.

Two alternative configurations of the curved cross section of the clamping members are desirable because they may be fabricated with simple manufacturing techniques. In one embodiment, one supporting area is positioned along a medial portion of the axial length of the clamping member, and a pair of clamping areas are positioned adjacent respective ends of the axial length of the clamping member. In another embodiment, one clamping area is positioned along a medial portion of the axial length, and a pair of supporting areas are positioned adjacent respective ends of the clamping member.

Another desirable feature of the invention, and which has the advantage of a particularly simple arrangement for introducing a biasing force to the clamping members, includes the provision of entrainment members which are connected to the clamping members, with one of the entrainment members being connected to the force applying means. In addition, the entrainment members assume the function of a radial inward support.

In one embodiment, the force applying means applies an axially directed force and the entrainment members are adapted to be displaced axially by the force. The entrainment members are able to move in the axial direction substantially without friction, so that the force of the force applying means can be applied to the clamping members entirely free of frictional losses.

The entrainment members may be connected to the clamping members via a hook-shaped interconnection which facilitates the application of a tensile force to the clamping members by the force applying means.

In another specific embodiment, the clamping members are connected to entrainment members which are rotatable relative to each other in the circumferential direction. This embodiment offers the advantage of a gentle introduction of force from the clamping members to the winding bobbin while insuring that the clamping forces on the bobbin are adequate. In this regard, the fact is taken into account that the clamping members contract particularly well under the action of a torque which enables the release of the winding spindle with a small angle of rotation.

It is recognized by those skilled in the art that yarn packages are subjected to large braking and accelerating torques at the beginning and at the end of a winding cycle. Also, as a result of the moment of inertia, the packages tend to maintain their rotational speed, particularly during braking. In such instances, it is necessary to prevent heavy, fully wound packages from slipping on the winding spindle, and thus large clamping forces must be applied to the winding bobbin by the clamping members at these times. Where the force applying means is adapted to apply a force in the circumferential direction of the winding spindle, it is possible to predetermine the direction of rotation of the clamping members such that the fully-wound packages act upon the clamping members during braking such that the clamping force increases. This is accomplished in that the fully-wound packages engage the clamping members during braking such that a rotation of the clamping members occurs from the idle condition in a direction of rotation toward an automatic locking.

The clamping members may be constructed at least in part in the shape of a ring and preformed in the shape of a bellows, with the folds extending obliquely across the longitudinal axis of the winding spindle. Here, the invention utilizes the knowledge that the moments engaging on the clamping members are introduced to the clamping members via pushing forces. When these pushing forces are resolved into tractive and compressive forces, it will be advisable to curve the clamping members outward in pulling direction and inward in the direction of compression. Consequently, each clamping member consists in cross sectional view of arcs which are curved outward, and arcs which are curved inward. The outwardly curved arcs are flattened out as a result of traction and consequently move radially inwardly. This movement is assisted by the already inward directed arc in the direction of compression.

In another embodiment, the clamping members are provided with continuous slots in the place of the inward directed arcs, with bridges being formed between the slots, which are lengthened by the reciprocal rotation of the front sides of a clamping element. This lengthening leads to a reduction in diameter.

By orienting the bellows-like folds parallel to one another, and preferably at 45° to the longitudinal axis, the force applying means can be dimensioned of smallest size and its force nonetheless suffices to fully disengage the clamping member. As a result, the winding spindle can be very light in weight, and consequently the spindle is permitted to rotate at high speeds.

In a further embodiment of the present invention, several axially spaced apart clamping members are connected with axially extending entrainment members, and the force applying means is operative on the axially last entrainment member. This configuration has the advantage that it becomes possible to duplicate, or otherwise multiply the clamping forces without substantially increasing the mass of the winding spindle.

The force applying means preferably is a piston-cylinder assembly which can be biased with a pressurized fluid. The piston is arranged for sliding movement such that when biased by pressure, it contacts a stop which is connected with the axially last entrainment member. This configuration has the advantage that the force applying means can be connected to a pneumatic source of pressure which is available everywhere in textile processing operations. However, it should explicitly be noted that also a hydraulic system may be used.

The clamping members and the entrainment members may each be in the form of annular rings, and they may be interconnected by a releasable coupling means which is operable by relative rotation of the members, so as to facilitate maintenance and replacement. This preferred coupling means includes, for example, screw couplings or bayonet type locks.

In the case of high speed winding spindles, it is preferable that both the entrainment members and the clamping members be of annular configuration. This offers the advantages of symmetry of rotation and thus low levels of vibration during high speed operation.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENTS

Figure 1:
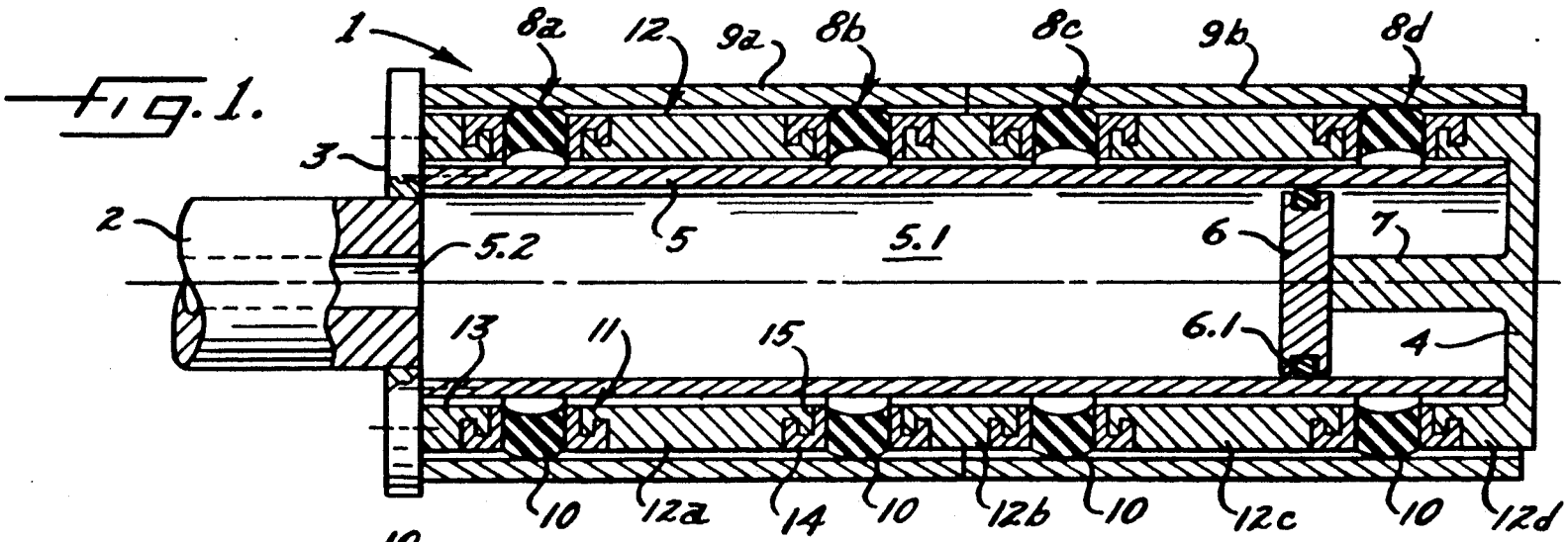
FIG. 1 is a sectioned side elevation view of a winding spindle which embodies the features of the present invention.

Referring more particularly to the embodiment illustrated in FIG. 1, a winding spindle is illustrated generally at 1, which embodies the features of the present invention, and which comprises a rotatably supported arm 2 which is supported in a manner (not shown) for rotation on the frame of a take-up machine for winding textile yarns. The arm 2 fixedly mounts a support plate 3, to which a cylinder 5 and a holding member 13, as further described below, are fixedly attached in a suitable manner.

These structural components 5 and 13 extend between the support plate 3 and a stop plate 4 at the free end of the winding spindle 1. The internally positioned cylinder 5 is a pressure cylinder, whose interior space 5.1 can be biased via an axial passageway 5.2 in arm 2 with a pressurized fluid. Inside the interior space 5.1, a piston 6 is arranged for sliding movement in such a manner that when the pressure cylinder 5 is filled with a pressurized fluid, the piston 6 is in the present illustration moved to the right, until it contacts a stop 7 which is connected to the stop plate 4. The piston 6 is sealed against the interior wall of the cylinder 5 by means of a peripheral O-ring 6.1.

A cylindrical bobbin support member 12 coaxially surrounds the cylinder 5 and comprises the annular holding member 13 and a plurality of coaxially aligned annular entrainment members **12*a*, 12*b*, 12*c*, and 12*d*. The entrainment member 12*d* at the free end of the support member 12 is connected to the stop plate 4. Between the entrainment members are positioned four annular clamping members 8*a–d* which are elastic, and which are configured and self-biased such that they exert by the action of their internal forces and substantially without the action of external forces radial clamping forces on winding bobbins 9*a–b***.

To this end, the clamping members curve radially outward along the axial direction, by the action of their internal forces, in the region of clamping areas 10 (FIG. 2A), while supporting themselves radially inward in the region of support areas 11.

The clamping areas 10 are those points of contact between the clamping members **8*a–d* and the winding bobbins 9*a–b***, on which the winding bobbins are connected with the clamping members in frictional engagement, as long as no external forces are operative on the clamping members.

At the support areas 11, which are radially inside the clamping areas 10, the radial force necessary to support the respective clamping force is absorbed, so that the outwardly curved regions of the clamping members rest against the inner sides of the winding bobbins **9*a–b*** under a certain pressure.

Figure 2B:
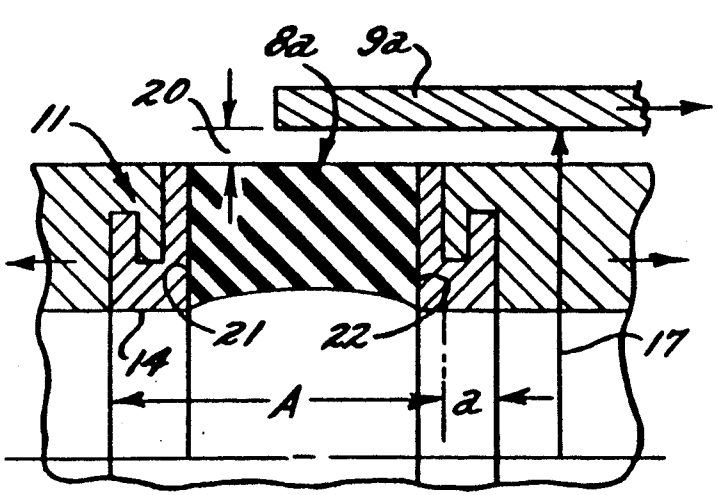
FIGS. 2A and 2B are enlarged fragmentary sectioned views of one of the clamping members in the radially extended and radially retracted positions, respectively.
Figure 2A:
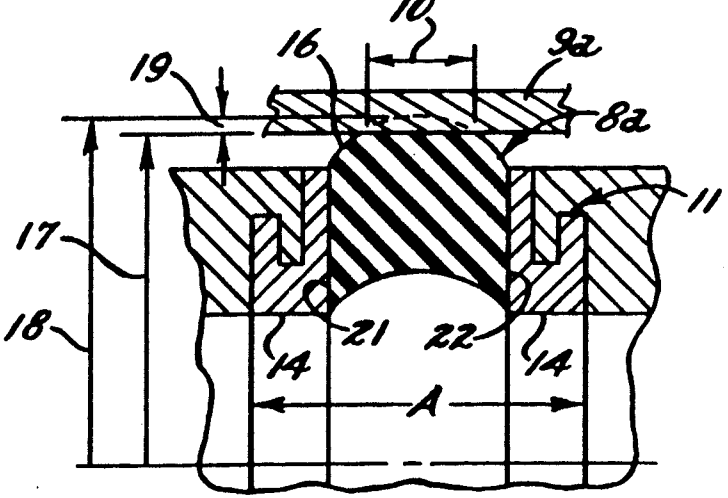
Figure 4:
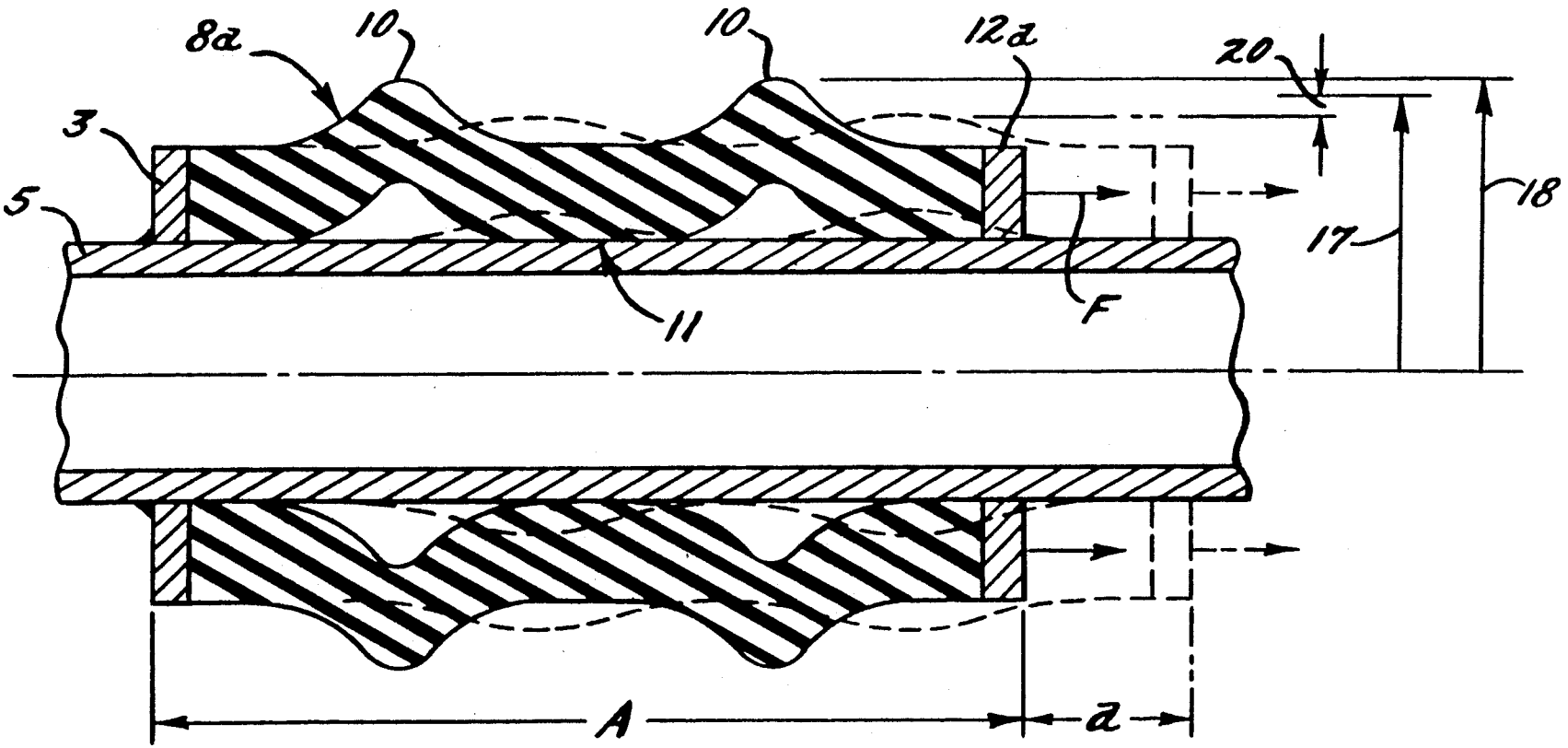
FIG. 4 is a sectioned side elevation view of another embodiment of a winding spindle in accordance with the present invention, and wherein clamping areas are located at the outer ends of the clamping member and a supporting area is positioned in the central area of the clamping member.

In the embodiment of FIGS. 1, 2A, and 2B, the clamping areas 10 are located in the central region of the axial extent of the respective clamping members 8a–d, and the support areas 11 are located at the respective two axial ends of the clamping members 8a–d. It is likewise within the scope of the invention, to have the support areas located in the central region of the axial extent of the clamping members, and the clamping areas arranged at the ends of the clamping elements. This latter embodiment is shown in FIG. 4.

The support areas 11 of the clamping members 8a–d support themselves on the entrainment members 12a–d as well as on the holding element 13, which provides for a firm connection between the first clamping element 8a and the support plate 3.

The entrainment members 12a–d connect the clamping members for a transmission of force with the biasing mechanism which comprises, in the present case the piston—cylinder assembly 5, 6.

When viewed in the embodiment of FIG. 1 in an axial direction from the support plate 3, four axially successive clamping members 8a–d are connected with four axially extending entrainment members 12a–d, and the biasing mechanism 5, 6 is operative on the axially last entrainment members 12d via the stop 7 and stop plate 4.

In the embodiment of FIG. 1, the coupling of the clamping members 8a–d with the entrainment members 12a–d permits an axial force to be transmitted, and so that the biasing mechanism 5, 6 engages on the ends of each clamping member 8a–d with an axially directed force. This is accomplished in that the ends of the clamping members are connected to the entrainment members 12a–d and the entrainment members are freely movable axially and can be displaced by the action of the biasing mechanism. However, in order to deform the clamping members due to the force introduced by the biasing mechanism, the first clamping member 8a is secured by means of holding element 13 to the stationarily attached support plate 3. To transmit the axially directed pulling force, each clamping member includes a metal hook-like element 14 on each side of the elastic portion, and each entrainment member has a mating hook 15 which engages in the hook-like element 14 of the clamping member.

In the illustrated embodiments, the clamping members 8a–d and the entrainment members 12a–d are each in the form of an annular ring, and are coaxially disposed. However, it should explicitly be stated, that this is but one preferred embodiment of the invention, which offers the above described advantages.

In a further embodiment of the invention, both the clamping members and/or entrainment members are at least in part annular, and have coupling regions which interlock in such a manner that they come to an engagement by a rotation relative to one another, as will b described below with reference to FIGS. 3A–3C. This constructional possibility is advantageous in that it makes the individual clamping members easily exchangeable, when the need arises.

In another embodiment of the invention, the clamping members are made of a vulcanizable material, such as, for example, rubber, and the entrainment members are of metal. The connection between the clamping members and the entrainment members is produced by vulcanization. This method of coupling also allows the metallic hook-like elements 14 to be mounted to the central rubber portions of the clamping members, and so as to enable an accurately fitting and nondeforming connection between the elements 14 on the clamping members and the hooks 15 on the entrainment members.

FIGS. 2A–2B serve to illustrate the operation of the winding spindle of the present invention. To this end, a clamping member 8a is shown which extends over an axial range A of the winding spindle.

Referring to FIG. 2A, the operation of the clamping member is illustrated for the situation when the biasing mechanism 5, 6 of FIG. 1 introduces an axial tensile force to the clamping members. This occurs, when the interior space 5.1 of the pressure cylinder 5 is biased by a pressurized fluid. As a result, the piston 6 is moved until it engages stop 7, and the force is transmitted via stop plate 4 to the axially last entrainment member 12d. A tensile force oriented in direction of movement of piston 6 is thus applied to the clamping members 8a–d by means of entrainment members 12a–d.

FIG. 2A shows the clamping member 8a of the present invention in a condition unbiased by external forces. For example, the elastic center portion consisting of rubber extends in the central portion of the axial length A, and curves to define a bulge 16 radially outward in the region of clamping area 10. In the present illustration, the clamping member is annular and joined by vulcanization on opposing lateral flanks 21, 22 with the there adjoining hook-like elements 14. In the illustrated embodiment, the inner winding bobbin 9a is situated on the winding spindle. This inner Winding bobbin 9a has an inside radius 17 which is smaller than the maximum radius 18 of the clamping member, which the bulge 16 would assume, were it not impeded in its radial expansion by the winding bobbin 9a. The dashed line illustrates the unobstructed curvature of the bulge 16. Since the elastic central portion rests against the inside wall of the winding bobbin 9a, the bulge 16 is compressed by a differential radius 19, so that the bulge 16 is flattened in the common region of the clamping area 10. As a result, an internal force directed radially outward forms in the elastic central portion, which exerts a radial clamping force on the winding bobbin 9a. The firm connection of the elastic central portion to the lateral flanks 21, 22 prevents the elastic central portion from moving radially inward, with the forces received via the common lateral flanks 21, 22 remaining within the clamping members and it being unnecessary to compensate for them by external forces.

When now the initially described external force is applied by means of biasing mechanism 5, 6 and by means of the pressurized fluid, as shown in FIG. 2B, the clamping element 8a undergoes a lengthening a beyond its original axial length A. As a result, the elastic central portion of the clamping element 8a contracts. As a result of the contraction, the maximum radius of the clamping member 8a retracts so far that it becomes smaller by a clearance 20 than the inside radius of the winding bobbin 9a. Consequently, the winding bobbin 9a can be removed unhindered from the winding spindle, as long as the pressurized fluid exerts by means of biasing mechanism 5, 6 external forces on the clamping element 8a.

Figure 3A:
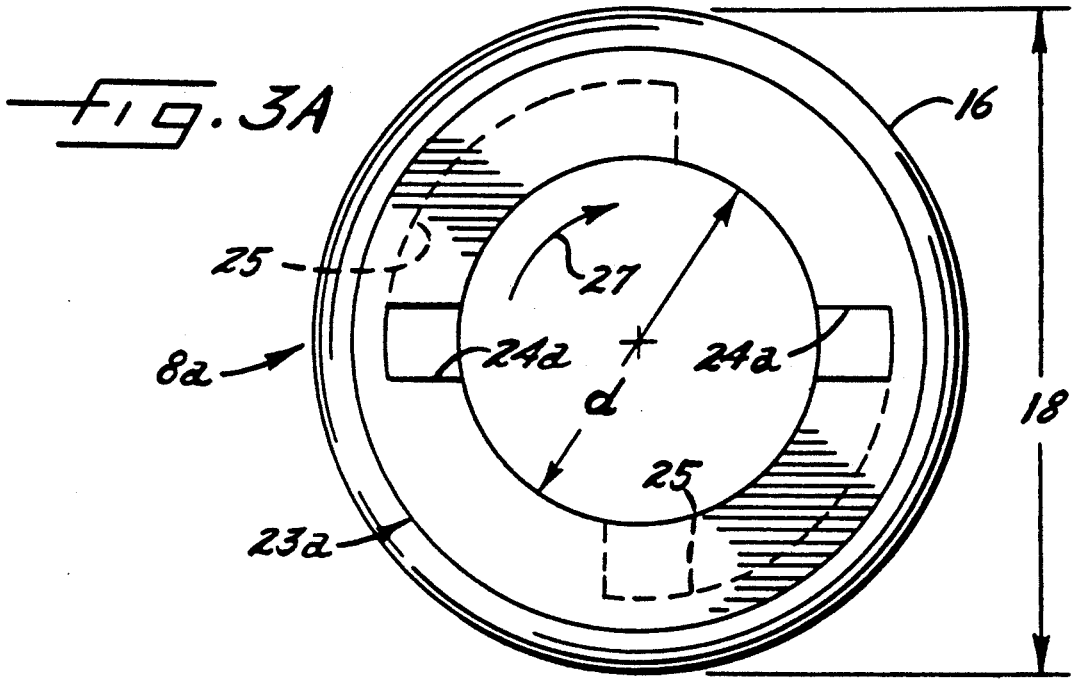
FIGS. 3A and 3B are end views of a clamping member and entrainment member respectively, and illustrating the releasable coupling means for interconnecting these components.
Figure 3B:
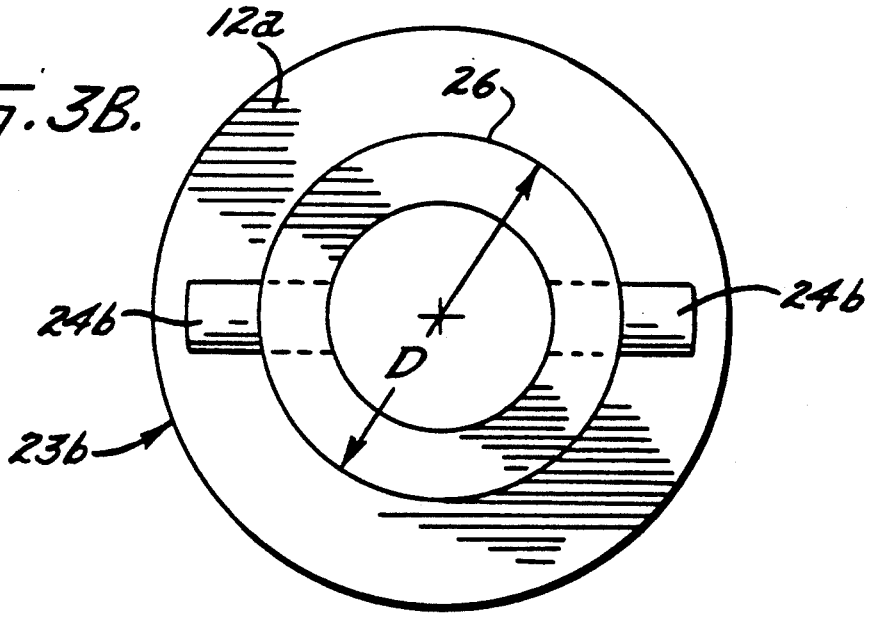
Figure 3C:
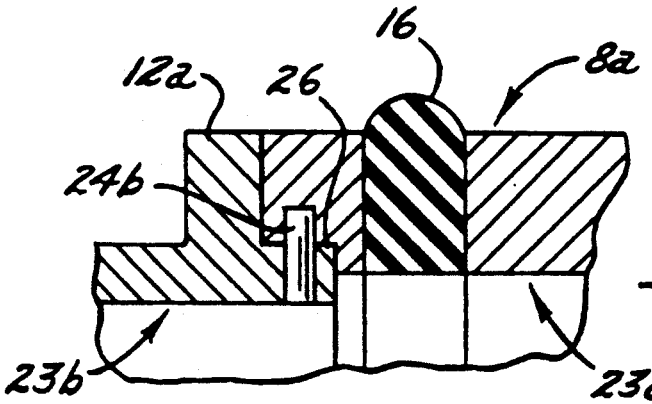
FIG. 3C is a fragmentary sectioned view further illustrating the coupling between the clamping member and the entrainment member of FIGS. 3A and 3B.

FIGS. 3A and 3B are top views respectively of a clamping member 8a and an entrainment member 12a. Both the clamping member 8a and the entrainment member 12a are constructed as closed rings and have two coupling segments 23a and 23b respectively. It should be noted that this is not intended to be a limitation of the invention, but that it suffices for carrying out the invention to make the clamping members and/or the entrainment members at least in part in the shape of a ring.

The coupling segments 23a of clamping member 8a are diametrically opposite and each extend over an angle of approximately 90°. Also, the coupling segments 23a each include diametrically opposite inlet openings 24a which continue along the dashed line as covered radial slots 25.

The coupling segments 23b of the entrainment means 12a comprises an annular shoulder 26, whose outside diameter D fits into the inside diameter d of the clamping member. Inserted and firmly anchored in annular shoulder 26 are diametrically opposite radial pins 24b.

The annular shoulder 26 is raised above the plane of the drawing by a length which is sufficient to permit the radial pins 24b to project freely from the sides from the annular shoulder, there being a spacing between each radial pin and the visible outer ring surface of the entrainment means 12a, which corresponds to the spacing between the visible inner ring surface of the clamping member 8a and the radial slot 25. This measure permits the entrainment member 12a which is brought with its visible side to the visible side of the clamping member 8a, to engage with its coupling segment 23b in coupling segment 23a of the clamping member such that both parts become engaged by a rotation relative to one another by the angular range 27. In so doing, it is necessary to bring together the entrainment member with the clamping member such that the radial pins 24b first engage in inlet openings 24a. Subsequently, both parts are rotated relative to one another until the radial pins contact the ends of the radial slots. As shown in the supplemental FIG. 3C, the bulge 16 projects from the common outside diameter of entrainment member 12a and clamping member 8a in the region of the coupling.

FIG. 4 illustrates another embodiment of the invention, which has, other than the foregoing features, a supporting area 11 in the central region of the axial length A, at which the clamping member 8a is supported on the cylinder 5 radially inward, when winding bobbin (not shown) with an inside radius 17 is inserted over the clamping member 8a. The clamping operation corresponds entirely to the foregoing description and is herewith incorporated by reference. The clamping areas 10, however, are arranged at the ends of the axial length A and extend in their unbiased condition on the maximum radius 18 of the clamping member, which is greater than the inside radius 17 of the winding bobbin.

For purposes of releasing the winding bobbin, a pulling force F is introduced in the manner already described in conjunction with the embodiment of FIG. 1, to the annular entrainment member 12a, which leads to a deformation of the clamping member 8a corresponding approximately to the course of the dashed line. It is clearly seen that as a result of the lengthening of the clamping member in the axial direction by the distance a, a decrease of the radius of the clamping member occurs. The length of distance a is selected such that the radius of the clamping member becomes smaller by the clearance 20 than the inside radius 17 of the winding bobbin, so that the winding bobbin is released from clamping member 8a, as long as the external force F remains activated.

Figure 5:
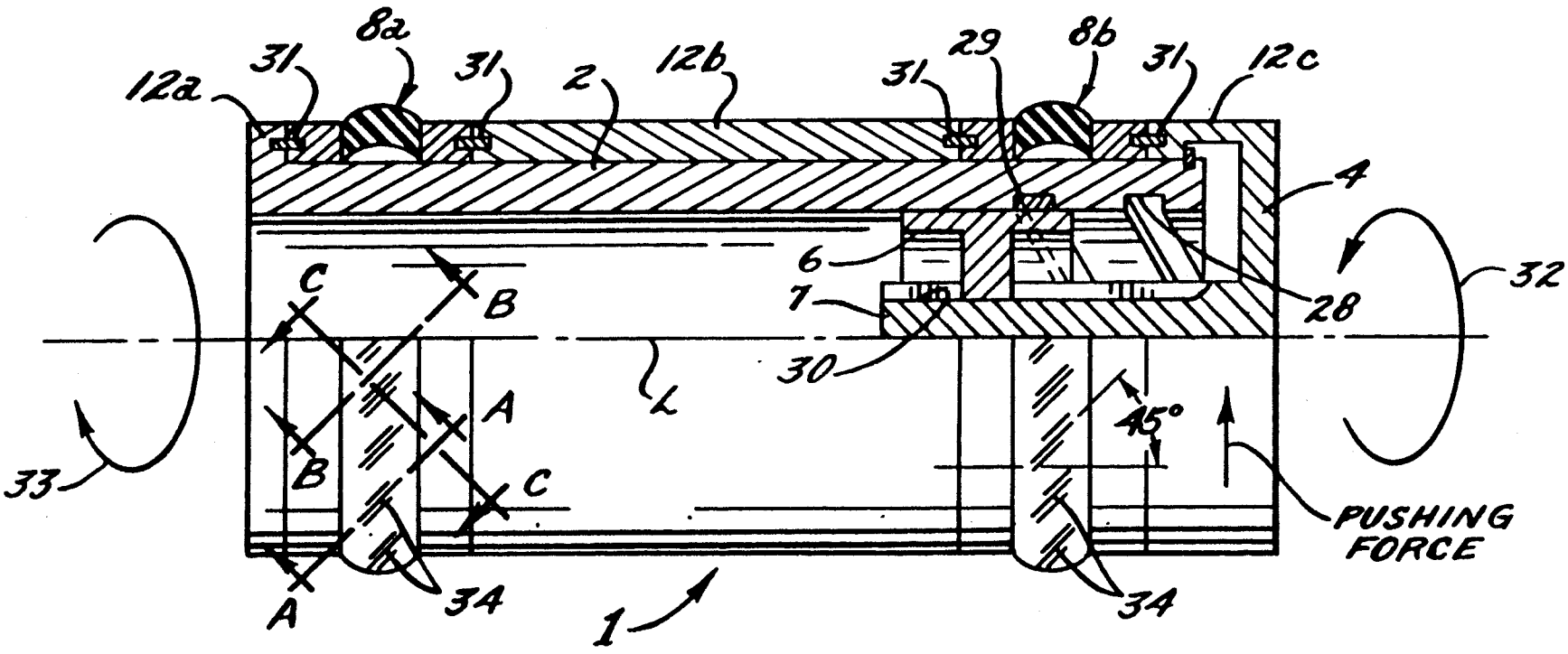
FIG. 5 is a partially sectioned side elevation view of still another embodiment of a winding spindle in accordance with the present invention and which includes rotatable clamping members.

FIG. 5 shows a further embodiment of the invention, which fully incorporates by reference the foregoing description as regards all details not mentioned in the following. In particular, like parts are provided with the same numerals.

FIG. 5 shows a winding spindle in accordance with the invention, in which the biasing mechanism which is likewise provided in the form of a piston 6, engages on the end of the clamping member 8b with a force in the circumferential direction of winding spindle 1, and in which the clamping members 8a–b are connected at their ends with entrainment members 12a–c, which are rotatable relative to one another in the circumferential direction of winding spindle 1.

The piston 6 is arranged in a support tube 2 for sliding movement in the axial direction. The support tube 2 is connected with the entrainment means 12a on the one hand and has at the free end of the winding spindle an internally extending spiral groove 28, in which the axially movable piston 6 engages by means of a guide piece 29. As one can see, the piston will move inside the support tube 2 to the right when pressure is applied from the left, it being necessary that the guide piece 29 follow the predetermined course of the spiral groove 28.

The piston 6 includes a central opening which receives a post extending axially from the stop plate 4. The post includes an axial groove 30, and the opening of the piston 6 is configured to extend into the groove 30. Consequently, the piston is force guided by the spiral groove 28 on the one hand and by the axial groove 30 on the other. The forced guidance results in the axially moving piston being also rotated in accordance with the pitch of the spiral groove 28. In so doing, it rotates the stop plate 4 via the axial groove 30 in the post, and the stop plate 4 thus rotates the entrainment member 12c on the right side of clamping member 8b. The entrainment member 12c is connected by means of a coupling device 31 to the opposing front surface of the clamping element 8b, so as to preclude relative rotation.

The rotational movement which the piston 6 exerts on the entrainment member 12c is thus transmitted to the clamping member 8b, and the entrainment member 12c then rotates relative to the next entrainment member 12b in the circumferential direction of the winding spindle by an angular distance.

To this end the left front surface of the clamping element 8b is likewise connected with a coupling device 31 to the further entrainment member 12b in such a manner that the rotational movement force by entrainment member 12c upon clamping element 8b is transmitted at least in part to the entrainment member 12b.

The entrainment member 12b is secured against rotation via the coupling device 31 with the first clamping member 8a. For this reason, the rotational movement forced upon entrainment member 12b is further transmitted to clamping member 8a the left front surface of which is secured via coupling device 31 to entrainment member 12a. The entrainment member 12a to connected to the support tube 2 so as to be secured against rotation. Consequently, the clamping member 8a is rotated by a certain angular distance as is clamping member 8b.

A special feature of this embodiment is that the clamping member 8a which is connected to the left end of the support tube 2 with the clamping member 8a, and which faces the takeup machine, is rotated due to the alternating effect of the rotational movement of piston 6 on the support tube 2, in opposite direction to the stop plate 4.

As one can easily picture, the rotational movement in the direction of rotation 32 at the free end of winding spindle 1 is introduced into the clamping members 8a and 8b respectively oppositely to the rotational movement in direction of rotation 33 of the support tube 2. However, it should explicitly be pointed out that this is a preferred embodiment and should not be limiting to the scope of protection of the invention.

The coupling devices 31 are preferably constructed as so-called coupling pins which are inserted into the clamping members 8*a* and 8*b* and the adjacent entrainment members 12*a–c*.

Both the entrainment members 12*a–c* and the clamping members 8*a–b* are secured on the support tube 2 for rotation in circumferential direction, but are stationary in the axial direction. This occurs between the diameter step which entrainment member 12*a* forms, and a corresponding axial anchoring at the right-hand end of the support tube, which is not indicated in more detail.

Furthermore, FIG. 5 shows that the clamping members are constructed in the form of annular rings and are preformed in the fashion of a bellows, whose folds 34 obliquely cross the longitudinal axis L of winding spindle 1. However, it should explicitly be stated that the invention is intended to comprise clamping members which are only partially ring-shaped, i.e., which do not enclose the winding spindle over its entire circumference.

In the present embodiment, the bellows folds 34 extend parallel to one another and form with the longitudinal axis L of the winding spindle an angle of 45°.

As further shown in FIG. 5, boundary surfaces are formed on the front sides of the clamping members, on which the entrainment members 12*a–c* engage. On these boundary surfaces, torques are introduced to the clamping members, for example, by pushing forces, which are ultimately responsible for the deformation of the clamping members in accordance with the invention. These torques engage on the annular front surface of the clamping members and effect a reciprocal rotation of opposing front surfaces of a clamping member in the sense of a torsional moment. As a result, the clamping members are rotated in a torsionlike manner, it being important that the introduced torsional moments be resolved into compressive and tractive forces.

This recognition can be utilized in the profiling of the clamping members for the invention. Specifically, FIGS. 6A–C show preferred cross sectional shapes for the clamping elements.

Figure 6A:
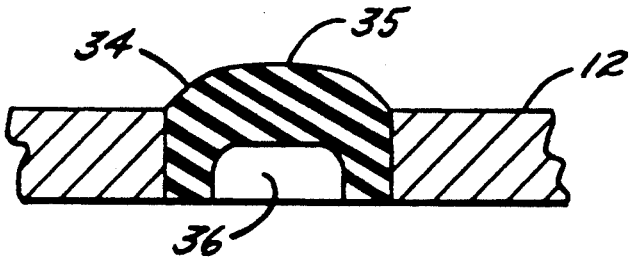
FIGS. 6A–6C are cross sectional views of the clamping members of FIG. 5, taken substantially along the lines A—A, B—B, and C—C.
Figure 6B:
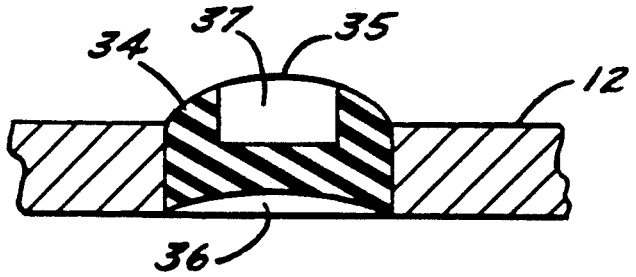
Figure 6C:
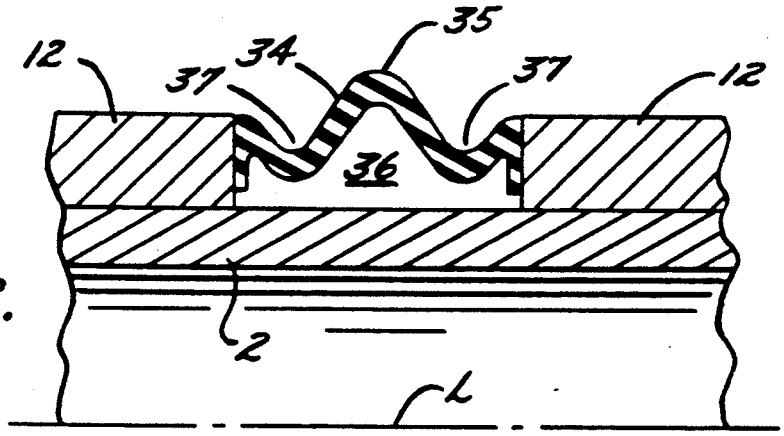

FIGS. 6A–C show that arcs 35 curved outwardly in direction of traction are present, which are flattened by the pulling force.

A cross sectional view of such an arc is shown in FIG. 6C, it being necessary to picture that according to FIG. 5 such an arc represents the fold 34 of a bellows, which is inclined at 45° to the longitudinal axis of the winding spindle.

As is further shown in FIG. 6A, which is a section along the line A—A of FIG. 5 extending in the place of a bellows fold 34, it is in the case of such a bellows fold a radial bulge of the clamping element with a radially inward directed hollow spaced 36.

Contrary thereto, FIG. 6B is a sectional view of the clamping element between two of such bellows folds 34 (line B—B of FIG. 5), i.e., a section along a valley between two successive folds. Although the clamping element has at this point likewise an inward directed hollow space 36, it has, however, in addition a radially outward extending recess 37 which is arranged on the outside surface of the bellows fold.

Figure 7:
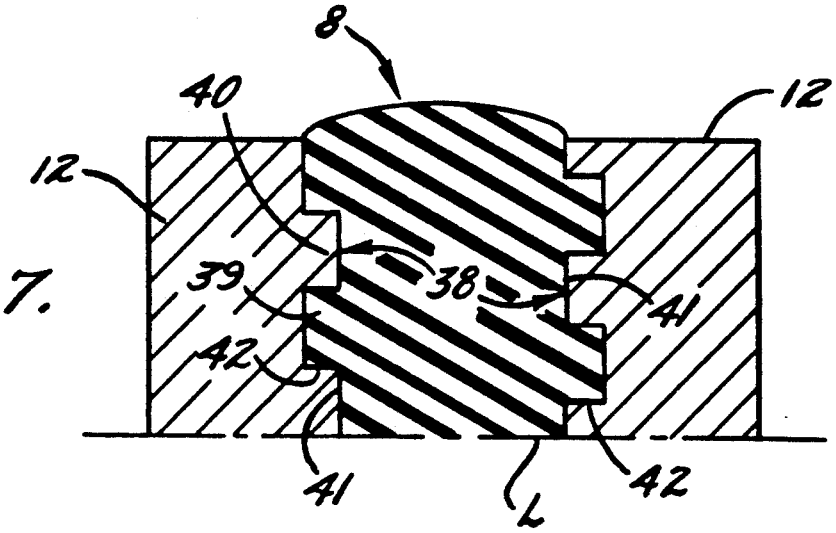
FIG. 7 is a fragmentary sectioned view which illustrates a possible connection between the clamping members and entrainment members of FIGS. 5 and 6.

As is further shown in FIG. 7, the boundary surfaces between the clamping members 8 and the neighboring entrainment members 12 may be configured such that the clamping members 8 mutually engage with the entrainment members 12 in the fashion of teeth 38.

The teeth 38 are formed such that they directly contact each other with their flanks 39, 40, with the tooth flanks 39 of the clamping member and the tooth flanks 40 of the entrainment means extending in a positive and a negative form.

In this special embodiment, the tooth flanks 39, 40 are provided with circumferentially extending ranges 41 which merge at the ends into axially extending ranges so as to subsequently reverse again in circumferential direction.

In this manner, it is possible to transmit in a particularly simple manner a high circumferential force from the entrainment members to the clamping members which are absorbed and transmitted free of wear by the axially extending ranges of the tooth flanks.

In the drawings and specification, there has been set forth a preferred embodiment of the invention, and although specific terms are employed, they are used in a generic and descriptive sense only and not for purposes of limitation.

That which is claimed is:

1. A winding spindle adapted to have a tubular yarn take-up bobbin mounted coaxially thereupon and which is characterized by the ability to grip the interior of the tubular bobbin during the winding of a yarn thereon and then release the bobbin to facilitate doffing, and comprising a cylindrical support member which defines an axial direction, said support member including at least one elastic clamping member mounted on the periphery thereof, with said at least one elastic member being configured and internally self-biased so as to assume a radially extended position in the absence of an external force being applied thereto and to assume a radially retracted position upon a biasing force being applied thereto, and means for selectively applying a biasing force to said at least one clamping member so as to permit its radial outward extent to be moved between said extended and retracted positions.

2. The winding spindle as defined in claim 1 wherein, in said extended position, said one clamping member includes at least one radially outer portion which is convexly curved in cross section to define at least one clamping area which is adapted to engage the interior of the tubular bobbin, and wherein said one clamping member is mounted so as to be supported at at least one supporting area which is radially inward from said one clamping area.

3. The winding spindle as defined in claim 2 wherein said one supporting area is positioned along a medial portion of the axial length of said one clamping member, and a pair of said clamping areas are positioned adjacent respective ends of the axial length of said one clamping member.

4. The winding spindle as defined in claim 2 wherein said one clamping area is positioned along a medial portion of the axial length of said one clamping member, and a pair of said supporting areas are positioned adjacent respective ends of the axial length of said one clamping member.

5. The winding spindle as defined in claim 4 wherein said support member further includes a plurality of axially spaced apart entrainment members, with said one clamping member being mounted between adjacent entrainment members at each of said supporting areas, and with said entrainment members being mounted so as to transmit the biasing force from said biasing force applying means to said one clamping member.

6. The winding spindle as defined in claim 5 wherein said one clamping member and each of said entrainment members are in the form of an annular ring and are coaxially disposed.

7. The winding spindle as defined in claim 1 wherein said biasing force means is adapted to apply an axially directed tensile force to said one clamping member.

8. The winding spindle as defined in claim 1 wherein said one clamping member is preformed into the configuration of a bellows and so as to define a plurality of fold lines which extend obliquely with respect to said axial direction.

9. The winding spindle as defined in claim 8 wherein said fold lines are parallel to each other and extend at an angle of about 45 degrees to said axial direction.

10. A winding spindle adapted to have a tubular yarn take-up bobbin mounted coaxially thereupon and which is characterized by the ability to grip the interior of the tubular bobbin during the winding of a yarn thereon and then release the bobbin to facilitate doffing, and comprising a cylindrical support member which defines an axial direction, said support member including a plurality of axially spaced apart, annular, elastic clamping members coaxially mounted on the periphery thereof, with each of said elastic members being configured and internally self-biased so as to assume a radially extended position in the absence of an external force being applied thereto and to assume a radially retracted position upon a biasing force being applied thereto, and means for selectively applying a biasing force concurrently to all of said clamping members so as to permit their radial outward extent to be moved between said extended and retracted positions.

11. The winding spindle as defined in claim 10 wherein said support member further includes a plurality of annular entrainment members which are relatively movable and which interconnect adjacent ones of said clamping members, and wherein one of said entrainment members is operatively connected to said biasing force applying means.

12. The winding spindle as defined in claim 11 wherein said entrainment members are mounted for axial movement, and wherein said biasing force applying means is adapted to apply an axial force to said one entrainment member and so that an axial tensile force is applied to each of said clamping members.

13. The winding spindle as defined in claim 11 wherein said entrainment members are mounted for circumferential movement, and wherein said biasing force applying means is adapted to apply a tangential force to said one entrainment member and so that a circumferential tensile force is applied to each of said clamping members.

14. The winding spindle as defined in claim 11 wherein said support member is tubular, and said biasing force applying means comprises a piston-cylinder assembly mounted in said tubular support member and such that the piston of said assembly is adapted to axially move into engagement with a stop which is in turn connected to said one entrainment member.

15. The winding spindle as defined in claim 14 wherein said annular entrainment members are interconnected to adjacent ones of said clamping members by releasable coupling means.

* * * * *